United States Patent [19]

Christensson

[11] Patent Number: 5,050,763

[45] Date of Patent: Sep. 24, 1991

[54] RECLOSING ARRANGEMENT FOR SQUARELY CROSS CUT CONTAINERS

[75] Inventor: Lars Christensson, Bromma, Sweden

[73] Assignee: Akerlund & Rausing Licens Aktiebolag, Jarfalla, Sweden

[21] Appl. No.: 440,032

[22] Filed: Nov. 21, 1989

[30] Foreign Application Priority Data

Nov. 23, 1988 [SE] Sweden ..... 8804229

[51] Int. Cl.[5] ..... B65D 43/06

[52] U.S. Cl. ..... 220/355; 220/307; 229/5.5; 229/125.13

[58] Field of Search ..... 220/306, 307, 354, 355; 229/125.01, 125.13, 5.5

[56] References Cited

U.S. PATENT DOCUMENTS 3,956,550 5/1976 Sutch ..... 229/125.13 X
4,192,434 3/1980 Conroy ..... 220/306
4,241,864 12/1980 Kessler ..... 229/5.5
4,495,209 1/1985 Whiteside ..... 229/5.5 X
4,667,843 5/1987 Galer ..... 220/354
4,887,735 12/1989 Dudzik ..... 220/307

*Primary Examiner*—Stephen Marcus
*Assistant Examiner*—Nova Stucker

[57] ABSTRACT

Reclosable lid frame having a continuous downwardly open groove (4) for receiving an upper edge part of a container and a quantity of connecting and sealing material for securing the lid frame to the container. At least the inner side wall of the groove is inclined upwardly and inwardly of the groove and has a plurality of integral spaced apart and upwardly extending ribs projecting therefrom. The ribs are substantially triangular with the longest side of each rib integral with the inner side wall of the groove. The ribs guide the lid frame into assembly with the container and cooperate with the inner side wall to define spaces for receiving connecting and sealing material as the lid frame is moved into assembly with the container.

21 Claims, 1 Drawing Sheet

RECLOSING ARRANGEMENT FOR SQUARELY CROSS CUT CONTAINERS

BACKGROUND OF THE INVENTION

The present invention generally relates to a reclosing arrangement for a container of cardboard, plastic or sheet metal and of the type which is adapted to be connected to a lid frame having an all around the lid frame extending groove, whereby a squarely cross cut top part of the container is introduced in said groove of the lid frame and is secured in this position by means of glue, wax, hot-melt or a similar material, and in which arrangement a reclosable lid is adapted to be connected inside or outside the lid frame, in particular under a powder proof or steam proof condition.

In a special embodiment of the invention the lid frame and the reclosable lid are formed integral, whereby the lid is rotatably connected to the lid frame over one or more hinges.

Many different types of reclosing arrangements of the above mentioned type are known since many years. In said known reclosing arrangements the connection groove of the lid frame for the upper edge of the container generally is formed with a slightly conical inner wall for facilitating the introduction of the container edge in the frame groove, and the container is secured in that an adherance substance in the form of glue, wax, so called hot-melt or a similar substance is applied in the frame groove with the substance in a hot or un-hardened condition, whereupon the container edge is introduced and becomes secured in that the adherance substance is solidified, dries or becomes hardened. One example of such a reclosing means is shown for instance in the German patent 1.511.087 (=FR 1.496.031).

It is important that the connection between the reclosing arrangement and the container is strong and safe so that the lid frame with the lid does not become loosened from the container; and that there is no leakage of air or of the packed goods from the container out in the ambient past the reclosing arrangement.

The known reclosing means of the said type are disadvantageous in a couple of respects.

When the container edge is being introduced in the frame groove the container is in sliding contact with the inner wall of the frame groove, and it may thereby happen that the upper edge of the container pushes the glue or wax away from said inner wall of the frame, whereby the glue or wax is removed from the contact surface of the inner wall and of the corresponding container side and the glue or wax is eventually pressed out and down to the exterior side of the container along the outer wall of the frame groove. This means that a weak and imperfect joint is obtained between the lid frame and the container; that leakages may appear between the container and the lid frame; and that the glue or another adhering substance, which is used, daubs the exterior side of the contanier which is usualy intended to have an aestetical appearance.

The lid frame, which is generally made of a plastic material, often has a poor stability and a poor torsional strength and the entire container therefore may be rather unstable, in particular when the lid is opened. It would simplify the handling of the container and the reclosing arrangement both in connection to the manufacture and the filling of the container and in connection to the following successive distribution of the packed goods if the lid frame had an improved stability.

Therefore there has been a need for a reclosing arrangement for a container of cardboard, plastic, sheet metal or a similar material, which reclosing means is designed so that the container can easily and safely be introduced in the connection groove of the lid frame, thereby eliminating the risk that the container presses off the connection and sealing substance when the upper part of container is introduced in the connection groove of the lid frame, or the risk that the connection substance is pressed out on the exterior side of the container; so that the complete container with the reclosing arrangement connected thereon has an improved stability and an improved torsional strength; and so that there is no risk of leakage from the container into the ambient past the lid frame.

According to the invention the above mentioned problems are solved by a reclosing arrangement in which the lid frame comprises several ribs on the inner wall surface thereof which faces the connection groove, which ribs extend mainly parallelly to the direction of introducing the container and which ribs:

support the upper edge of the container while being introduced in the frame groove, and also act as side wall surfaces for a certain volume of glue or wax thereby preventing the risk that the glue or wax is pressed away by the upper edge of the container.

and which also stabilize the lid frame and the entire container.

A container closure assembly is known from the U.S. Pat. No. 4,192,434 in which the frame groove has parallel side walls and is formed with ribs on both wall surfaces which are facing the groove, which ribs extend from the bottom of the groove and some distance down, and which are adapted to cut themselves into the material of the container when the container is introduced in the groove of the lid frame. It may be difficult or even impossible to introduce a thin or weak container in the groove of the above mentioned known container closure assembly; there is no glue connection between the lid frame and the container; and apart therefrom the said ribs would still not be capable of preventing the container from pressing eventuelly existing glue away from the lid frame groove; and the said ribs further open leakage-ways from the interior of the container into the material of the container and also out into to the ambient.

Therefore it is important:

that at least the inner wall of the lid frame groove is converging in the direction of introducing the container;

that at least said converging surface of the lid frame groove is formed with several ribs;

that the ribs are likewise converging in the direction towards the bottom of the groove thereby forming contact edges for slidingly introducing the upper part of the container;

that preferably said ribs as a whole are conically tapering towards the bottom of the groove;

and that at least the innermost part of the ribs end on the surface of the inner wall of the lid groove at or adjacent the bottom of the frame groove.

Further characteristics of and advantages with the invention will be evident from the following detailed specification in which reference will be made to the accompanying drawings.

DESCRIPTION OF PREFERRED EMBODIMENT

Figure 1:
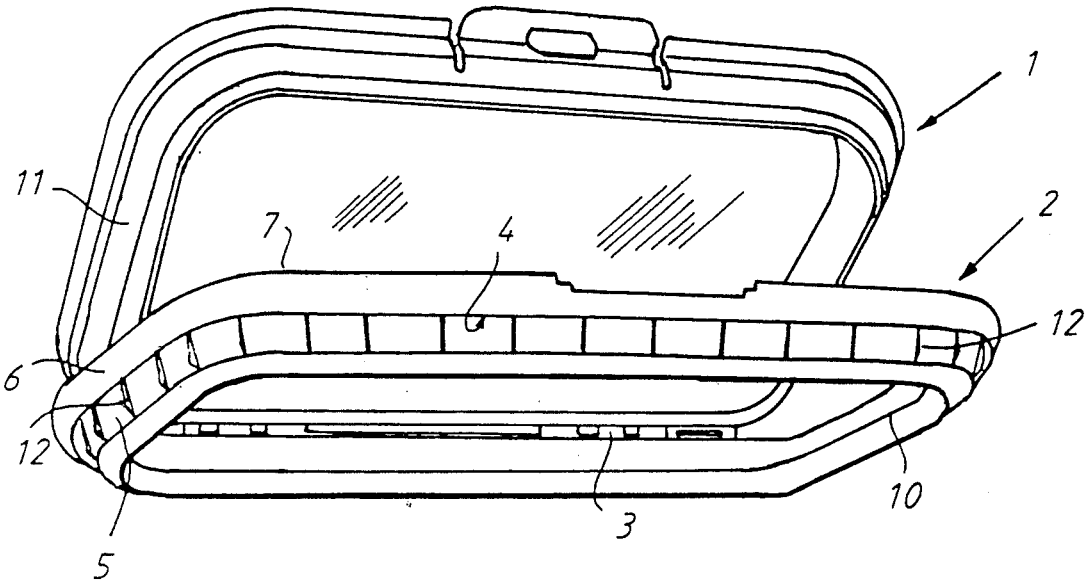
FIG. 1 shows a reclosing arrangement according to the invention seen from underneath without the container and with the lid partly opened.

The reclosing arrangement shown in FIG. 1 is of the type formed as an integral unit comprising a lid 1 and a lid frame 2, in which the lid 1 is rotatably connected to the lid frame 2 over one or more hinges 3, and in which the lid 1 is adapted to engage inside the lid frame. It should be emphasized that the lid may as well be separate from the lid frame, and the lid may, as desired, be formed so as to engage inside or outside the lid frame. This is of no importance to the invention.

As known, the lid frame 2 is formed with a downwardly open frame groove 4 comprising an inner wall 5, an outer wall 6 and an upper end 7, which is well the upper side of the frame. The frame groove 4 is adapted to enclose a squarely cross cut upper edge 8 of a container 9, which is intended to be secured in the frame groove 4 by means of glue, wax, hot-melt or a similar connection and sealing material, which material is not shown in the drawings for the sake of clearness. The connection and sealing material generally is applied as a string of material in the frame groove 4, whereby said material extends at least some distance down along the inner wall 5 from the upper end 7 of the groove 4 and eventually along both the inner wall 5 and the outer wall 6 of the groove. The frame groove 4 preferably has a conically tapering shape, whereby at least the inner wall 5 extends slightly conically tapering towards the groove upper end 7. As usual the frame may be formed with a sealing lip 10 which is sealingly engaging the outer wall 11 of a lid 1 which is engaging inside the frame 2.

In order to avoid that the glue or wax is pressed away from the inner wall 5 and is perhaps pressed out on the exterior side of the container by the upper edge 8 of the container 9, when the container end is being introduced in the frame groove 4, the inner wall 5 of the groove is formed with several ribs 12 which are preferably arranged mainly parallelly to the direction of introducing the container 9 in the groove 4, but which may for special purposes be arranged at some angle to said direction of introduction. The ribs 12 should be somewhat conically tapering in the direction towards the upper end of the groove 4, and at least the top edge 14, or preferably both the bottom edge 13 and the top edge 14 of the ribs should be located on the surface of the inner wall 5.

Figure 2:
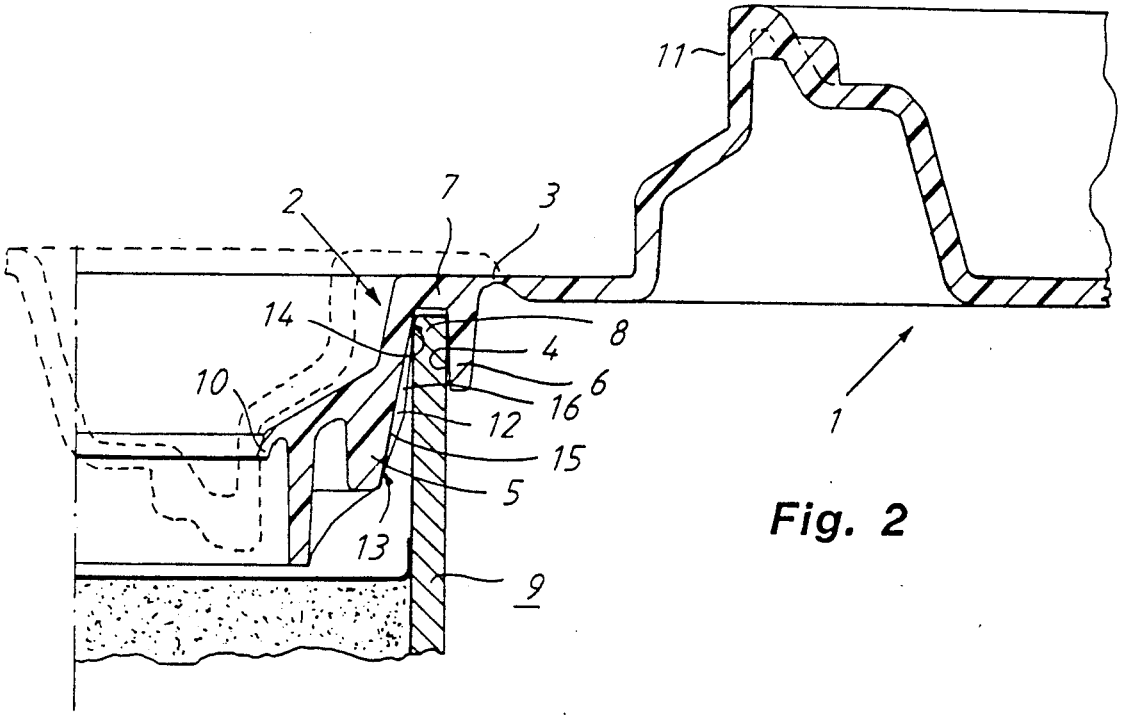
FIG. 2 shows a cross section through a little part of a container having a reclosing arrangement according to the invention, with the lid fold up (full lines) and with the lid closed (dotted lines).

As shown in FIG. 2 the ribs 12 can be formed with a lower slide part 15 for facilitating the guiding of the container 9 into the groove 4, and with an upper glue carrier part 16 in which the ribs act as side walls for a volume of glue or wax (not shown) which is introduced in the frame groove 4. The ribs may be bow-formed, but as shown in FIGS. 1 and 2 the ribs 12 may be substantially triangular, whereby the longest side of the rib-triangle is made integral with the inner wall 5 of the connection groove 4. The container also slides along the edges of said glue carrier part 16 at a late stage of introducing the container in the groove 4. The ribs 12 thereby eleminate the risk that the glue or wax is pushed in front of the upper edge 8 of the container 9 when the container is being fully introduced in the frame groove 4. The ribs also strengthen the frame 2 and thereby the entire container-lid arrangement.

The ribs 12 also can be arranged to extend over the upper end 7 of the groove and eventually also along the outer wall 6 of the frame groove 4. By arranging ribs also at the bottom of the frame groove it is possible to have glue or a similar material to penetrate into the cross cut cardboard material of the cardboard container rather than being pressed away by the upper edge 8 of the container.

The ribs also can be arranged on different distances from each other. It can be especially suitably to arrange the ribs closer to each other at corners of the container or at other places where the container engages the inner wall of the frame with higher pressure than the average container pressure. Oppositely, ribs can be excluded at other places of the frame.

What is claimed is:

1. Reclosing arrangement for a container (9) of cardboard, plastic or sheet metal and of the type which is adapted to be connected to a lid frame (2) having an all around extending and downwardly open frame groove (4) in which a squarely cross cut top part of the container is to be introduced and secured in position by means of glue, wax, hot-melt or a similar connection and sealing material, and in which a reclosing lid (1) is adapted to be connected inside or outside the lid frame (2), in particular under a powder proof or steam proof condition, characterized in that at least the inner wall (5) of the frame groove (4) tapers inwardly into the frame groove and in the direction towards the upper end (7) of the frame groove (4), in that at least the inner wall (5) of the frame groove (4) is formed with several ribs (12) extending mainly in the direction of introducing the container (9) in the frame groove (4), and in that the ribs (12) are formed with a lower, tapered upwards and to the inner portion of the frame groove (4) extending entering part (15) for facilitating the introduction of the container sliding on the edges of the ribs (12) of the frame groove (4), and an upper rib part (16) forming side walls for a volume of connection and sealing material and against the edges of which the container is likewise adapted to slide when being introduced in the frame groove (4), thereby preventing the connection and sealing material from being forced out of the frame groove (4).

2. Arrangement according to claim 1, characterized in that the edges of both parts (15, 16) of the ribs (12) are tapered inwardly into the frame groove and in the direction towards the upper end (7) of the frame groove (4).

3. Arrangement according to claim 1, characterized in that the ribs are subtantially triangular with each longest side of the rib-triangle formed integral with the inner wall (5) of the frame groove (4).

4. Arrangement according to claim 1, characterized in that the upper parts (16) of the ribs (12) end proximate the upper end (7) of the frame groove (4).

5. Arrangement according to claim 1, characterized in that the ribs (12) extend along the inner wall (5) of the frame groove (4) and along the upper end (7) and along the outer wall (6) of the frame groove (4).

6. Arrangement according to claim 1 characterized in that the container is generally rectangular, the frame groove (4) is generally rectangular and the ribs are arranged closer to each other at corners of the frame groove (4) than at straight sides of the the frame groove (4).

7. Arrangement according to claim 2, characterized in that the ribs are substantially triangular with the longest side of each rib-triangle formed integral with the inner wall (5) of the frame groove (4).

8. Arrangement according to claim 2, characterized in that the inner parts (16) of the ribs (12) end proximate the upper end (7) of the frame groove (4).

9. Arrangement according to claim 3, characterized in that the inner parts (16) of the ribs (12) end proximate the upper end (7) of the frame groove (4).

10. Arrangement according to claim 2, characterized in that the ribs (12) extend along the inner wall (5) of the frame groove (4) and along the upper end along the outer wall (6) of the frame groove (4).

11. Arrangement according to claim 2, characterized in that the ribs (12) extend along the inner wall (5) of the frame groove (4) and along the upper end (7) and along the outer wall (6) of the frame groove (4).

12. Arrangement according to claim 4, characterized in that the ribs (12) extend along the inner wall (5) of the frame groove (4) and along the upper end (7) and along the outer wall (6) of the frame groove (4).

13. Arrangement according to claim 2 characterized in that the container is generally rectangular, the frame groove (4) is generally rectangular, and the ribs are arranged closer to each other at corners of the frame groove (4) than at straight sides of the frame groove (4).

14. Arrangement according to claim 3 characterized in that the container is generally rectangular, the frame groove (4) is generally rectangular, and the ribs are arranged closer to each other at corners of the frame groove (4) than at straight sides of the frame groove (4).

15. Arrangement according to claim 4 characterized in that the container is generally rectangular, the frame groove (4) is generally rectangular, and the ribs are arranged closer to each other at corners of the frame groove (4) than at straight sides of the frame groove (4).

16. Arrangement according to claim 5 characterized in that the container is generally rectangular, the frame groove (4) is generally rectangular, and the ribs are arranged closer to each other at corners of the frame groove (4) than at straight sides of the frame groove (4).

17. Reclosable lid assembly having a lid frame (2) for connection to a container having a square cut top end, the lid frame (2) having a continuous downwardly open groove (4) for receiving the top end of the container and a quantity of connecting and sealing material for securing the lid frame (2) to the container, characterized by said lid frame (2) having inner and outer side walls (5 and 6) partially defining said groove (4), at least said inner side wall (5) being inclined upwardly and inwardly of said groove (4), and a plurality of spaced apart ribs (12) projecting into said groove (4) from at least said inner side wall (5), said ribs (12) having surfaces inclined generally upwardly and inwardly into said groove for guiding the top end of a container as it is introduced into said groove (4), whereby the connecting and sealing material may occupy spaces between said spaced apart ribs (12) when the lid frame (2) is connected to the container to prevent said connecting and sealing material from being forced out of said groove.

18. Reclosable lid frame assembly as set forth in claim 17 further characterized in that each of said ribs (12) is formed by two parts 15 and 16 having surfaces inclined relative to each other.

19. Reclosable lid assembly as set forth in claim 17 further characterized in that said ribs (12) are substantially triangular and the longest side of each triangular rib 12 is formed integrally with said side wall (5).

20. Reclosable lid assembly as set forth in claim 17 further characterized in that the upper end of each rib (12) terminates proximate the upper end of said groove (4).

21. Reclosable lid assembly as set forth in claim 17 further characterized in that said frame groove (4) is generally rectangular and said ribs are closer to each other near the corners of the frame groove (4).

* * * * *